United States Patent [19]

Lawson

[11] 4,380,794

[45] Apr. 19, 1983

[54] SURGICAL LAMP CHARACTERIZED BY HAVING AN IMPROVED REFLECTOR

[75] Inventor: Alfred C. Lawson, Fairport, N.Y.

[73] Assignee: Sybron Corporation, Rochester, N.Y.

[21] Appl. No.: 274,055

[22] Filed: Jun. 15, 1981

[51] Int. Cl.[3] ..... F21V 7/00

[52] U.S. Cl. ..... 362/296; 362/33; 362/294; 362/350; 362/804

[58] Field of Search ..... 362/33, 294, 296, 307, 362/343, 350, 804

[56] References Cited

U.S. PATENT DOCUMENTS

| | | | |
|---|---|---|---|
| 3,586,851 | 6/1971 | Rudolph | 362/32 X |
| 4,254,455 | 3/1981 | Neal, Jr. | 362/296 |
| 4,292,664 | 9/1981 | Mack | 362/296 X |
| 4,354,012 | 10/1982 | Scola | 526/259 |
| 4,355,368 | 10/1982 | Ziedler et al. | 364/728 |

*Primary Examiner*—Peter A. Nelson

*Attorney, Agent, or Firm*—Robert A. Gerlach; Robert J. Bird

[57] ABSTRACT

A surgical lamp includes a thermoplastic reflector which reflects visible light but passes infrared radiation. The reflector is fabricated from molded polyetherimide plastic resin. A dichroic coating is vacuum deposit directly upon the front surface of the reflector.

1 Claim, 1 Drawing Figure

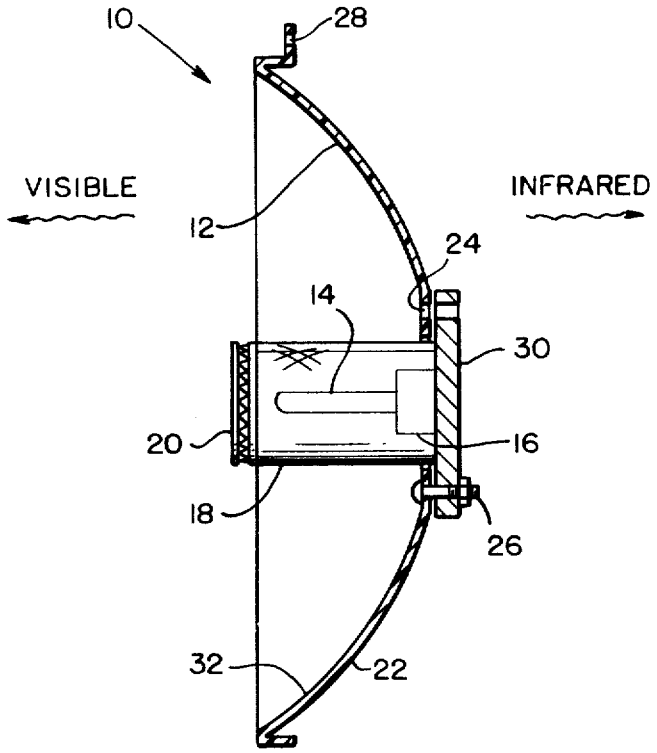
10
28
VISIBLE
INFRARED
12
24
14
30
20
16
18
26
32
22

SURGICAL LAMP CHARACTERIZED BY HAVING AN IMPROVED REFLECTOR

BACKGROUND OF THE INVENTION

This invention pertains to surgical lamps and more particularly is concerned with light reflectors for such lamps. Modern surgical practice calls for artificial light sources to illuminate the surgical area with broad spectrum light to assure accurate color. A tungsten-halogen bulb, for example, emits the full range of desired visible light, but will also emit undesirable ultraviolet and infrared radiation. Undue exposure to either bands could burn the tissue of the patient and the surgeon. The tungsten-halogen bulb may be surrounded by a material which absorbs most of the ultraviolet radiation, but the infrared radiation must be allowed to pass to avoid excessive heat buildup close to the bulb. Light is emitted omni-directionally from the bulb, so a reflector is used to direct the light to a surgical area. Polished aluminum and other metals have been used as reflector materials, but are deficient as they reflect infrared radiation to the surgical area. Heat resistant glass is now used as a reflector material in most surgical applications. The glass is coated with a dichroic material which reflects visible light towards the patient but transmits infrared light harmlessly out the back of the lamp. The glass must also be molded to an appropriate shape and must be both temperature and shatter resistant. Suitable glass is a dense and expensive material. Furthermore, an expensive clamp arrangement may be used to secure a glass reflector to the surgical lamp. It would be of benefit to both the manufacturer and the purchaser of surgical lamps for the weight and cost of reflectors to be successfully reduced, yet still provide the high performance required for such an appliance.

It has been suggested to use polycarbonate, polyphenylene sulfide, and polysulfone for reflectors. Each of these plastic materials has been found to have properties which distracts from its usefulness as a surgical lamp reflector.

Polycarbonate cannot tolerate the 140° C. temperature a reflector is exposed to and this material was quickly removed from consideration.

Polyphenylene sulfide and polysulfone meet the temperature requirements, but both materials are sensitive in different degrees to ultraviolet light. Because of this reason, it is necessary to apply an ultraviolet absorbing base coat on the face of the reflector prior to the deposition of the dichroic coating. The base coat also provides better adhesion for the dichroic coating which would otherwise require a high surface temperature during deposition.

It is the object of the invention to provide a relatively low cost, low density plastic reflector for use in surgical lamps without the need of an ultraviolet absorbing base coat.

BRIEF DESCRIPTION OF THE DRAWING

The single drawing is a cross sectional view of a surgical lamp which includes a reflector embodying the invention.

DESCRIPTION OF THE INVENTION

Referring to the drawing, there is seen in cross section, a surgical lamp 10 which includes a reflector 12 embodying the invention. The light source is a tungsten-halogen bulb 14 capable of emitting a spectrum of light from ultraviolet through infrared. The bulb extends from a socket 16 located in the center of the reflector 12. Surrounding the bulb 14 is a cylinder 18 of borosilicate doped glass capable of attenuating, but not eliminating, radiated ultraviolet light. Light emitted from the bulb 14 is reflected from the surface of reflector 12 which directs the light to the surgical area. A screen 20 shades the surgical area from the direct rays of bulb 14. Shade 20 is supported by cylinder 18.

As a feature of the invention, the blank 22 of reflector 12 is molded from polyetherimide resin in heated molds to have a curved surface having the desired optical properties. The blank 22 has molded or bored clearance holes 24 for screws 26 holding socket 16 and heat sink 30 at the center of the reflector. Additional clearance holes 28 may be provided about the outer periphery of the reflector to allow attachment to a housing (not shown).

Polyetherimide resin is sold by the General Electric Company under the registered ULTEM trademark. This material can operate continuously at 170° C. This property allows direct deposition of a dichroic coating without a base coat. Furthermore, the stability of this material is such as to be almost immune to ultraviolet light.

I have found by utilizing these properties an ultraviolet absorbing base coat previously called for by the prior art is no longer required. The base coat was previously necessary to aid adhesion of the dichroic coating to a plastic blank and protect the plastic from the damaging effects of ultraviolet radiation.

Following my invention the molded ployetherimide blank 22 is placed in a vacuum chamber where a dichroic coating 32 is deposited directly upon the front surface of the reflector. No intermediate coat is required in contrast with prior art.

During use, visible light is reflected to the surgical area, but the dichroic coating and the polyetherimide reflector are both transparent to infrared radiation which is allowed through both the coating and the polyetherimide so the infrared radiation from bulb 14 does not heat patient and the surgeon.

Accelerated life tests were conducted on the claimed surgical lamp to simulate the equivalent of eight years use. It was found that the performance of the claimed lamp reflector for the critical functions of illumination of color coordinates and color temperatures is equivalent to that of glass reflectors.

I claim:

1. An improved surgical lamp of the type having a broad spectrum light source which emits ultraviolet, visible and infrared light and a reflector, wherein the improvement is comprised of:

(a) a reflector blank molded from polyetherimide resin; and (b) a dichroic coating deposited directly upon the front surface of said reflector blank for reflecting visible light while passing infrared light.

* * * * *